US006248173B1

(12) United States Patent
Dixon

(10) Patent No.: US 6,248,173 B1
(45) Date of Patent: Jun. 19, 2001

(54) MAGNETIC COATING MASKING MEMBER

(76) Inventor: David Dixon, 157 Rockwell Ave., Bristol, CT (US) 06010

( * ) Notice: Subject to any disclaimer, the term of this patent is extended or adjusted under 35 U.S.C. 154(b) by 0 days.

(21) Appl. No.: 09/292,167

(22) Filed: Apr. 15, 1999

Related U.S. Application Data

(60) Provisional application No. 60/087,431, filed on Jun. 1, 1998.

(51) Int. Cl.[7] ..... B05C 11/11

(52) U.S. Cl. ..... 118/505; 118/301; 118/504

(58) Field of Search ..... 16/251, DIG. 2; 150/155; 118/505, 301, 504; 427/282

(56) References Cited

U.S. PATENT DOCUMENTS 196,419 * 10/1877 Blake .
1,590,629 * 6/1926 Julius ..... 118/505
2,014,072 * 9/1935 Newmann .
3,961,602 * 6/1976 Dresser .
4,796,330 * 1/1989 Ziegler ..... 16/251
5,198,031 * 3/1993 Derstine ..... 118/505
5,285,014 * 2/1994 Gilchrist ..... 118/505
5,702,774 12/1997 Griffin et al. .
5,800,894 * 9/1998 Navis ..... 118/505

* cited by examiner

*Primary Examiner*—Brenda Adele Lamb
(74) *Attorney, Agent, or Firm*—Handal & Morofsky

(57) ABSTRACT

A coating masking system comprising a member having face and reverse sides is disclosed. This member is magnetically adhered to a hinge over which a coating is not to be applied.

3 Claims, 6 Drawing Sheets

MAGNETIC COATING MASKING MEMBER

This application claims priority to provisional application No. 60/087,431 filed Jun. 1, 1998.

BACKGROUND OF THE INVENTION

1. Field of the Invention

The present invention relates to temporary masks and protective coverings useful for preventing paint or other coatings from being deposited on ferromagnetic objects or surfaces.

2. Description of Related Art Including Information Disclosed under 37 CFR 1.97 and 37 CFR 1.98.

During painting or coating operations of a home's interior, it is necessary to keep certain areas, such as, door hinges, light and socket covers, or any other surfaces free from being painted or coated. The standard method for preventing a door hinge or some other area from being coated with paint or stain involves using different types of adhesive-backed tapes to cover or "mask off" the areas over which a coating is undesirable. Even if the areas are to be covered with some other type of "mask" such as plastic sheeting or masking tape that material still needs to be taped into place. In any event the covering these selected surfaces is a slow, tedious and expensive process.

Not masking the door hinges or doing a poor job in masking them leads to unsightly coating of the hinges which could lead to the door not opening or closing properly. Eventually, the coating covering the hinges will have to be removed. Removal can be accomplished in two ways. The first method involves physically removing the coating by scraping it off or using an abrasive such as steel wool. The second methods involves chemically removing the coating using harsh solvent. In utilizing either time consuming and labor intensive method, the underlying metal surface is likely to be marred.

If chemical solvents are used to remove paint or stain, they may also pose a threat to the safety and health of the user. Most common wood stains are oil-based and must be removed with commercially available stain removers. These stain removers typically contain methylene chloride which causes damage to the central nervous system if inhaled over prolonged periods. They are also eye and skin irritants and can be potentially fatal if swallowed.

Alternatively, a door and its hinges could be removed from the door jamb altogether. However, if the door itself needs to be painted or stained, the hinges must also be removed from the door. A standard interior door in a residential building has three hinges each held in place by at least three screws. Removal of the hinge from this door is a time-consuming process.

Therefore, there is a substantial need for a means to mask the hinges of a door in place, which is quickly and easily applied and removed.

SUMMARY OF THE INVENTION

The present invention solves the problem of masking door hinges or other metallic surfaces which need to be covered during interior home painting. It also provides economy of time in the painting or coating of doors insofar as the hinges are left free of any deposit which must be removed after a coating is applied.

This invention contemplates a coating masking member having a face side and a reverse side. The face side is a vinyl film, and the reverse side is a magnetic backing. The coating masking member conforms to the shape of an area over which a coating is not to be applied. The coating masking member may contain a handle or handles to effect easy removal of the coating masking member from the surface to which it is applied.

Alternatively, the coating masking member may contain two planar members having face sides and reverse sides, the face sides having a vinyl film disposed upon them and the reverse sides having magnetic surfaces disposed upon them. The two planar members are connected by a flexible sheet having a face side and a reverse side. The flexible sheet conforms to the shape of a hinge pin that connects the first and second hinge plates of a hinge. This coating masking member may conform to the shape of a door hinge.

Furthermore, this coating masking member may contain at least one handle connected to it to effect easy removal of the coating masking member from a surface.

The invention further contemplates a method for using the coating masking member. This method involves the placing of the coating masking member onto a door hinge, coating the surface of the door or its surrounding area, and then removing the coating masking member once the coating has dryed.

DETAILED DESCRIPTION OF THE INVENTION

Figure 1:
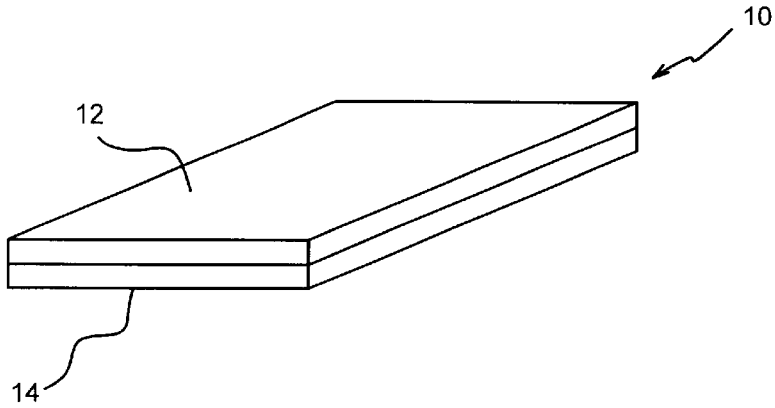
FIG. 1 is an isometric view of the inventive system constructed in accordance with the present invention.

Referring to FIG. 1, an inventive magnetic coating masking member is illustrated. Coating masking member 10 is a planar member comprising a face side 12 and a reverse side 14. Face 12 has disposed on it a coating 13. Coating 15 may be formed from a polyvinyl film or coating. Reverse side 14 is formed from material 15. Material 15 is a backing sheet with magnetic properties, such as a synthetic rubber or elastomer having magnetized barium or strontium ferrite particles interspread within.

In practice the inventive magnetic coating masking member is cut to its desired dimensions from pre-manufactured sheets of magnetic sheeting. These pre-manufactured sheets are commercially available.

Coating masking member 10 is of planar dimensions that correspond to the planar dimensions of the hinge plate of a hinge. Commercially available hinge plates are available in a variety of shapes and sizes; therefore, coating masking member 10 can be manufactured in a variety of shapes and sizes. A hinge plate with corners having ninety degree angles would require coating masking member 10 to have corners having ninety degrees. Similarly, as in FIG. 12, a hinge plate having rounded corners would require coating masking member 10 to have rounded corners.

Figure 2:
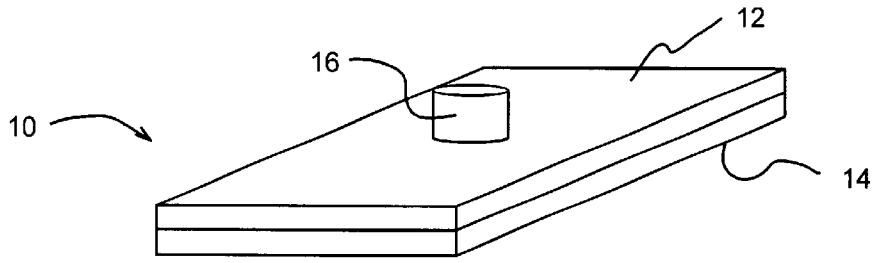
FIG. 2 is an isometric view of an alternate embodiment of the inventive system wherein a handle is utilized to effect easy removal from a surface to which the inventive system is applied.
Figure 3:
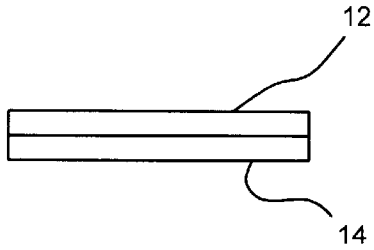
FIG. 3 is a cross-sectional view of the inventive system illustrated in FIG. 1.

As shown in FIG. 2, a handle 16 may be attached to the face side 12 of coating masking member 10. Handle 16 may be centered on coating masking member 10, or it may be placed off-center, or at the end to allow the user ease of placement and removal. Handle 16 is used to effect easy removal of the coating masking member 10 after it has been magnetically applied to the surface of a hinge plate and after a coating has been applied. Handle 16 may be constructed of wood, plastic, or similar material. An adhesive material can be used to attach handle 16 to coating masking member 10. Furthermore, handle 16 may be in the shape of a peg, a knob, or any similar shape that lends itself to being utilized as a handle. A plurality of handles may be utilized on a single coating masking member 10.

The coating masking member 10 may also be of varying thicknesses to accommodate for differences between spraying the coating and brushing the coating onto the surface around which the coating masking member 10 is situated. The thickness of coating masking member 10 if a coating is to be brushed on should preferably be between 0.050 and 0.078 inches. The thickness of coating masking member 10 if a coating is to be sprayed on may be substantially less and preferably between 0.020 and 0.048 inches.

Figure 13:
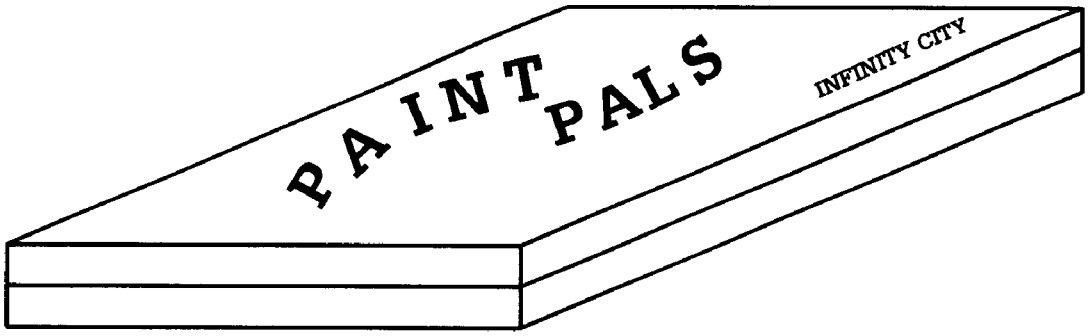
FIG. 13 is an isometric view of an alternate embodiment of the inventive system having a business logo printed on it.

The coating masking member can have a company logo or a slogan printed on it. FIG. 13 illustrates a coating masking member 10 having such a logo.

Figure 4:
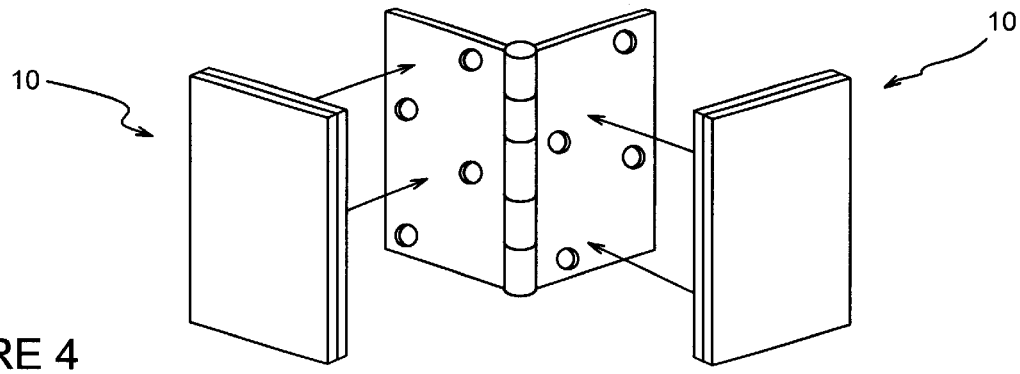
FIG. 4 is an isometric view of the inventive systems as they are applied to the plates of a hinge.
Figure 5:
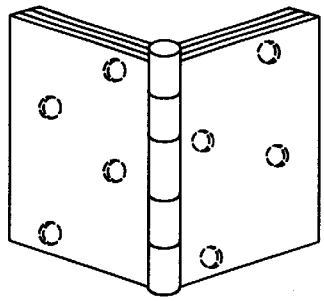
FIG. 5 is an isometric view of the inventive systems applied to the plates of a hinge.

As illustrated and FIGS. 4 and 5, when it is desired to use the inventive coating masking member in accordance with the present invention, a pair of coating masking members 10 are placed over a door hinge 20 in the direction of arrows 22. Paint or other coating can then be applied to the surrounding areas of the surface to which door hinge 20 is mounted. The paint can be applied liberally as coating masking member 10 protects the surface of door hinge 20. After the paint or other coating material has dried coating masking member 10 can be removed from door hinge 20, leaving behind a hinge free from coating.

Figure 6:
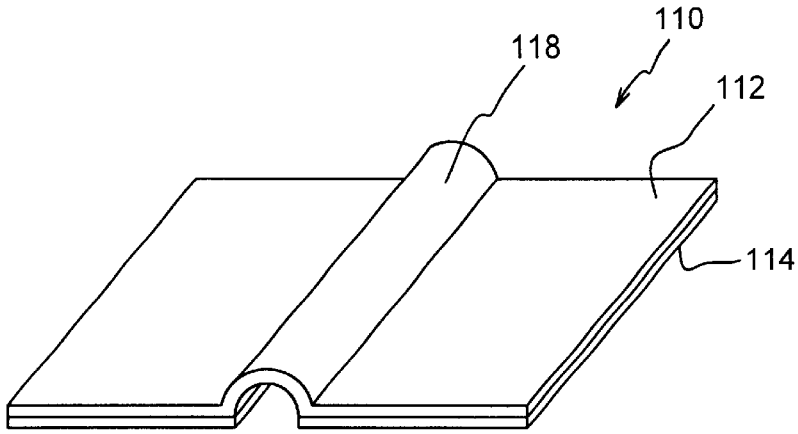
FIG. 6 is an isometric view of the inventive system which contains a flexible sheet connecting the planar members and is utilized for covering a hinge pin and its connected hinge plates.

Another embodiment of the invention is illustrated in FIG. 6. The inventive magnetic coating masking member 110 in FIG. 6 is comprised of two planar members each having a face side 112 and a reverse side 114. Similar to the earlier described embodiments, face sides 112 have disposed on them coatings made of vinyl or plastic. Reverse sides 114 are magnetic backings. Face sides 112 are joined by a flexible piece of material 118 corresponding to the shape of the hinge pin of a hinge.

Flexible piece of material 118 is attached to face sides 112 along one edge of each face side 112 by using an adhesive. Alternatively, flexible piece of material 118 can be melted onto the edge of face side 112. In either case, flexible piece of material 118 should fit snugly over the hinge pin of the hinge that coating masking member 110 is masking.

Figure 7:
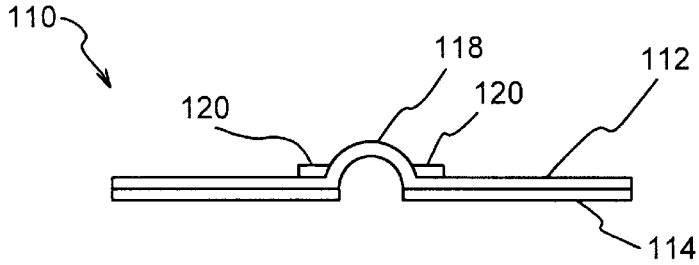
FIG. 7 is a cross-sectional view of the inventive system illustrated in FIG. 6.

FIG. 7 illustrates a cross-sectional view of coating masking member 110 showing a bead 120 of adhesive material along the edge of flexible piece of material 118.

Figure 9:
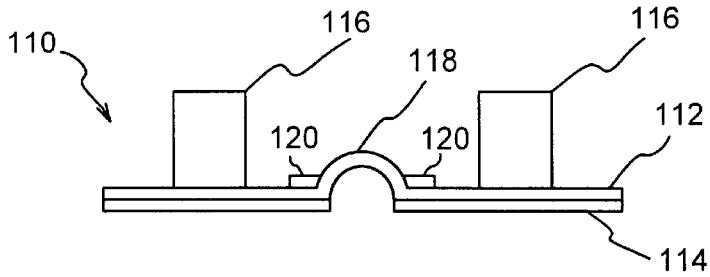
FIG. 9 is a c ross-sectional view of the inventive system illustrated in FIG. 8.
Figure 8:
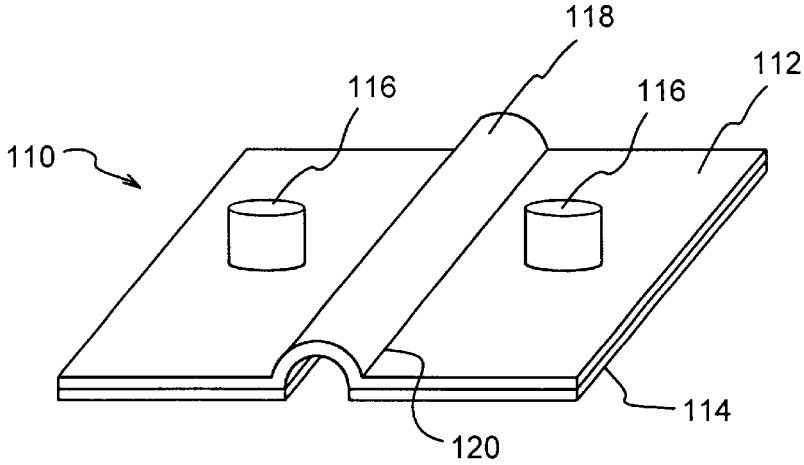
FIG. 8 is an isometric view of an alternate embodiment of the inventive system illustrated in FIG. 6 containing handles to facilitate easy removal of the system from a hinge.

The alternative embodiment of coating masking member 110 may also have a handle 116 or a plurality of handles 116 to facilitate the removal of coating masking member 110 from a metal surface. FIGS. 8 and 9 show isometric and cross-sectional views of coating masking member 110 having handles 116. Handles 116 are attached to surfaces 112 in the same manner as in FIG. 2.

Figure 10:
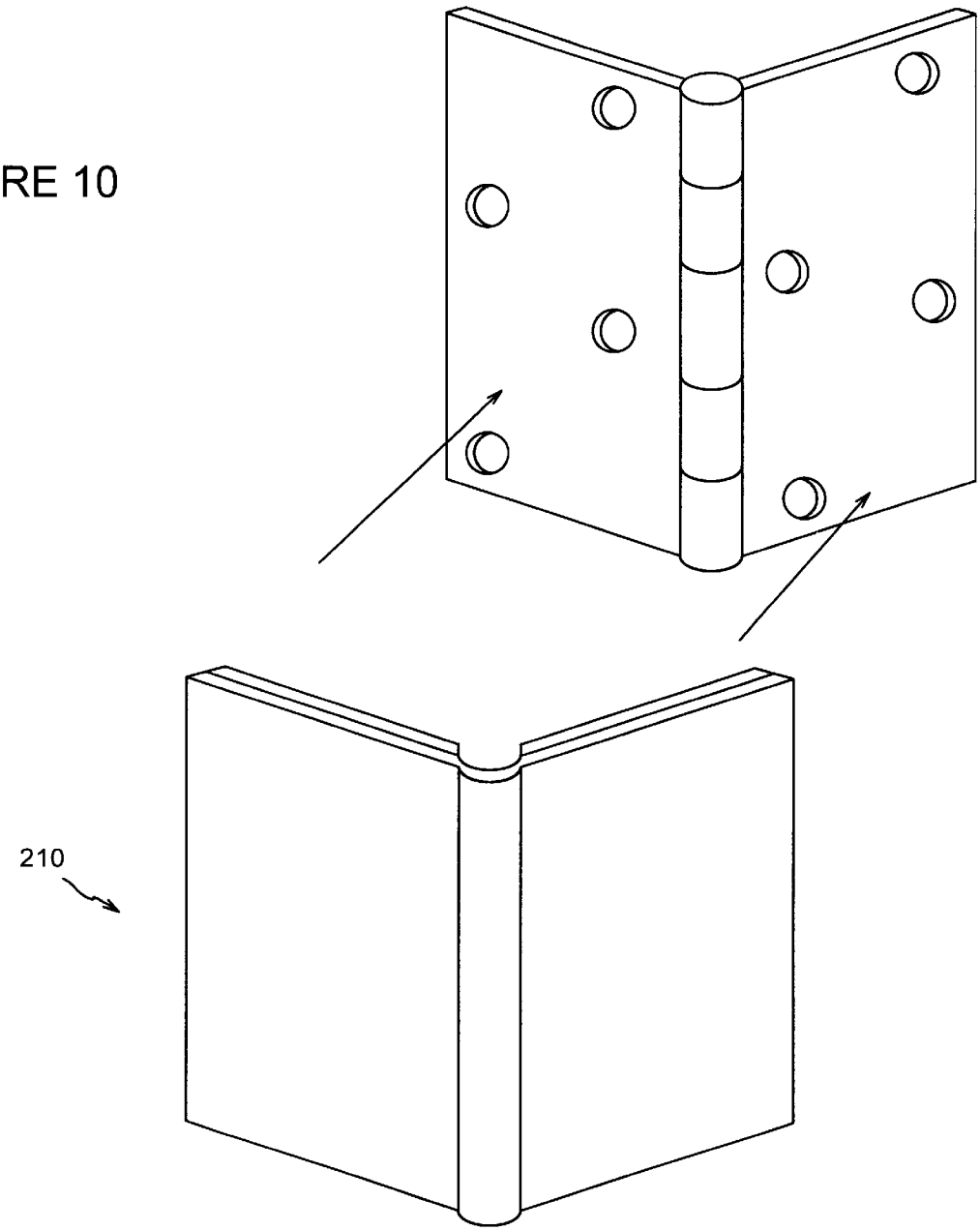
FIG. 10 is an isometric view of the alternate embodiment illustrated in FIG. 6 as it is applied to a hinge.
Figure 11:
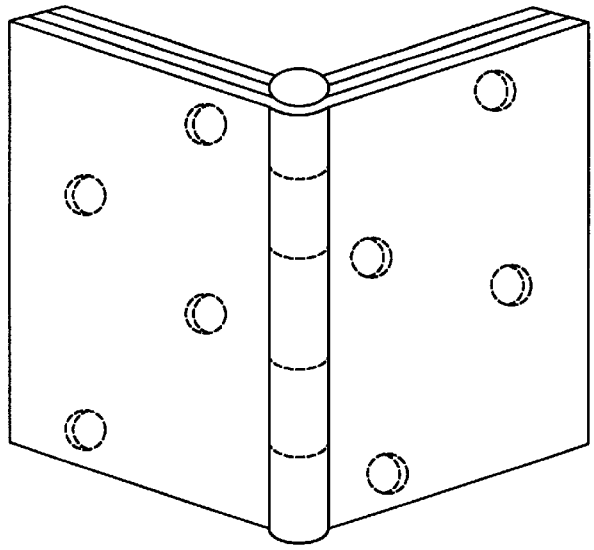
FIG. 11 is an isometric view of the alternate embodiment illustrated in FIG. 6 applied to a hinge.

Coating masking member 110 is applied to a hinge by placing it onto the hinge as in FIG. 10. In this manner, the entire embodiment covers the entire hinge. FIG. 11 illustrates coating masking member 110 in place on the hinge.

Figure 12:
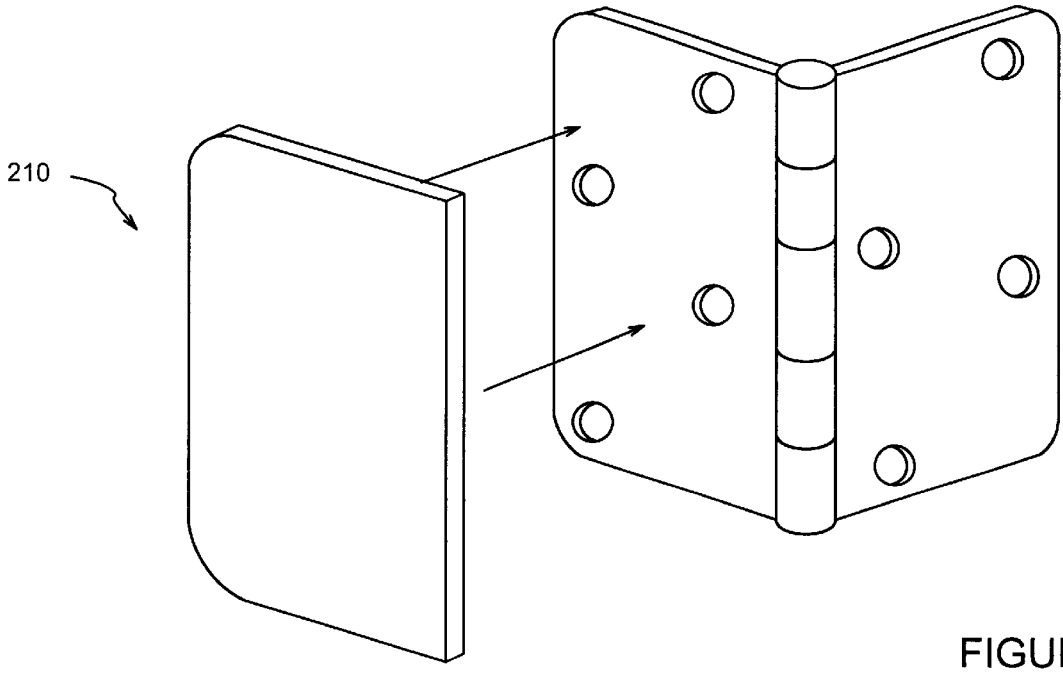
FIG. 12 is an isometric view of an alternate embodiment similar to that illustrated in FIG. 6 but having rounded corners corresponding to the shape of a hinge having rounded corners.

FIG. 12 illustrates coating masking member 210 having rounded edges. Coating masking member 210 is applied to a hinge in the same manner as coating masking member 10 is applied in FIG. 4. Furthermore, an embodiment with rounded edges may be of the form as coating masking member 110, which comprises two planar members connected by a flexible sheet. Such an embodiment would be applied to a hinge in the same manner as in FIG. 10.

I claim:

1. A masking member for preventing a coating from being applied to a ferromagnetic door hinge having two face plates connected by a hinge pin comprising:

(a) a first planar member having a first side and a second side, said first side of said first planar member having a polymeric film disposed upon it, and said second side having a magnetic properties;

(b) a second planar member having a first side and a second side, said first side of said second planar member having a polymeric film disposed upon it, and said second side having a magnetic properties;

(c) a flexible hinging member adhered to said first planar member and said second planar member, said flexible hinging member having a substantially arcuate shape so as to snugly fit over a portion of the hinge pin; and (d) a first handle adhered to the first side of said first planar member and second handle adhered to the first side of said second planar member to facilitate placement and removal of said masking member, wherein said first and said second planar member are dimensioned to fit over entire outer facing surface of the flat plates such that when said masking member is magnetically coupled to the door hinge said masking member protects by covering each of the face plates and the portion of the hinge pin.

2. A masking member as in claim 1, wherein said masking member has printed indicia on the first side of one of said first planar member and said second planar member.

3. A masking member as in claim 2, wherein said printed indicia comprises promotional advertising information.

* * * * *